US007065486B1

(12) United States Patent
Thyssen

(10) Patent No.: US 7,065,486 B1
(45) Date of Patent: Jun. 20, 2006

(54) LINEAR PREDICTION BASED NOISE SUPPRESSION

(75) Inventor: Jes Thyssen, Laguna Niguel, CA (US)

(73) Assignee: Mindspeed Technologies, Inc., Newport Beach, CA (US)

( * ) Notice: Subject to any disclaimer, the term of this patent is extended or adjusted under 35 U.S.C. 154(b) by 625 days.

(21) Appl. No.: 10/122,964

(22) Filed: Apr. 11, 2002

(51) Int. Cl.

| | |
|---|---|
| ***G10L 21/02*** | (2006.01) |
| ***G10L 19/04*** | (2006.01) |
| ***G10L 19/08*** | (2006.01) |
| ***G10L 19/10*** | (2006.01) |
| ***G10L 11/06*** | (2006.01) |

(52) U.S. Cl. ..... 704/227; 704/226; 704/219; 704/215

(58) Field of Classification Search ..... 704/227, 704/226, 219, 215

See application file for complete search history.

(56) References Cited

U.S. PATENT DOCUMENTS

| | | | | |
|---|---|---|---|---|
| 5,781,883 | A * | 7/1998 | Wynn | 704/226 |
| 6,070,137 | A * | 5/2000 | Bloebaum et al. | 704/227 |
| 6,104,994 | A * | 8/2000 | Su et al. | 704/233 |
| 6,694,293 | B1 * | 2/2004 | Benyassine et al. | 704/229 |
| 2001/0005822 | A1 * | 6/2001 | Fujii et al. | 704/200 |

OTHER PUBLICATIONS

Hansen, John. Clements, Mark. "Constrained Iterative Speech Enhancement with Application to Speech Recognition", IEEE Transactions of Signal Processing, vol. 39, No. 4, Apr. 1991.*

* cited by examiner

*Primary Examiner*—Susan McFadden
*Assistant Examiner*—Matthew J Sked
(74) *Attorney, Agent, or Firm*—Farjami & Farjami LLP

(57) ABSTRACT

Various time-domain noise suppression methods and devices for suppressing a noise signal in a speech signal are provided. For example, a time-domain noise suppression method comprises estimating a plurality of linear prediction coefficients for the speech signal, generating a prediction error estimate based on the plurality of prediction coeficients, generating an estimate of the speech signal based on the plurality of linear prediction coefficients, using a voice activity detector to determine voice activity in the speech signal, updating a plurality of noise parameters based on the prediction error and if the voice activity detector determines no voice activity in the speech signal, generating an estimate of the noise signal based on the plurality of noise parameters, and passing the speech signal through a filter derived from the estimate of the noise signal and the estimate of the speech signal to generate a clean speech signal estimate.

13 Claims, 4 Drawing Sheets

LINEAR PREDICTION BASED NOISE SUPPRESSION

BACKGROUND OF THE INVENTION

1. Field of the Invention

The present invention is generally in the field of speech coding. In particular, the present invention is related to noise suppression.

2. Background Art

Noise reduction has become the subject of many research projects in various technical fields. In the recent years, due to the tremendous demand and growth in the areas of digital telephony using the Internet and cellular telephones, there has been an intense focus on the quality of audio signals, especially reduction of noise in speech signals. The goal of an ideal noise suppressor system or method is to reduce the noise level without distorting the speech signal, and in effect, reduce the stress on the listener and increase intelligibility of the speech signal.

Common existing methods of noise suppression are based on spectral subtraction techniques, which are performed in the frequency domain using well-known Fourier transform algorithms. The Fourier transform provides transformation from the time domain to the frequency domain, while the inverse Fourier transform provides a transformation from the frequency domain back to the time domain. Although spectral subtraction is commonly used due to its relative simplicity and ease of implementation, complex operations are still required. In addition, the overlap and add operations, which are used in the spectral subtraction techniques, often cause undesireable delays.

FIG. 1 illustrates an overview of a traditional spectral subtraction process, wherein operations to the left of dashed line 105 are performed in the time domain and operations to the right of dashed line 105 are performed in the frequency domain. By way of background, an observed speech signal (or noisy speech signal) comprises a clean speech signal and an additive noise signal, wherein the additive noise signal is independent of the clean speech signal.

FIG. 1 shows observed speech signal y(n) 102, where "n" is a time index. As shown, Fourier transform module 112 receives observed speech signal y(n) 102 and computes power spectrum $P_y$ 113, as the magnitude squared of the Fourier transform. At estimate of noise spectrum module 114, estimated noise spectrum $P_n$ 115 is approximated, typically from a window of signal in which no speech is present. Next, spectral subtraction module 116 receives and subtracts estimated noise spectrum $P_n$ 115 from power spectrum $P_y$ 113 of observed speech signal y(n) 102 to produce an estimate of clean speech spectrum $P_x$ 117. The estimate of clean speech spectrum $P_x$ 117 is then combined with phase information 118 obtained from observed speech signal y(n) 102 to yield an estimate of the Fourier transform of a clean speech signal. Finally, inverse Fourier transform module 120 along with overlap and add module 122 construct estimated clean speech signal x(n) 124 in the time domain.

In applying the inverse Fourier transform, it is assumed that phase information 118 is not critical, such that only an estimate of the magnitude of observed speech signal y(n) 102 is required and the phase of the enhanced signal is assumed to be equal to the phase of the noisy signal. Although this approximation may work well in applications with high signal to noise ratios (SNRs), e.g. >10 dB, it can result in significant errors with low SNRs.

The spectral subtraction method of noise suppression involves complex operations in the form of Fourier transformations between the time domain and frequency domain. These transformations have been known to cause processing delays and consume a significant portion of the processing power.

Thus there is an intense need in the art for low-complexity noise suppression systems and methods that can substantially reduce the processing delay and processing power associated with the traditional noise suppression systems and methods.

SUMMARY OF THE INVENTION

In accordance with the purpose of the present invention as broadly described herein, there is provided method and system for suppressing noise in time-domain to enhance signal quality and reduce complexity, delay and processing power.

According to one aspect of the present invention, various time-domain noise suppression methods and devices for suppressing a noise signal in a speech signal are provided. For example, a time-domain noise suppression method comprises estimating a plurality of linear prediction coefficients for the speech signal, generating a prediction error estimate based on the pluraility of prediction coeficients, generating an estimate of the speech signal based on the plurality of linear prediction coefficients, using a voice activity detector to determine voice activity in the speech signal, updating a plurality of noise parameters based on the prediction error and if the voice activity detector determines no voice activity in the speech signal, generating an estimate of the noise signal based on the plurality of noise parameters, and passing the speech signal through a filter derived from the estimate of the noise signal and the estimate of the speech signal to generate a clean speech signal estimate. In a further aspect, the plurality of noise parameters include $A_{noise}(z)$ and $\Sigma\ r^{2noise}(n)$. In one exemplary aspect, the plurality of linear prediction coefficients are associated with a linear predictor, and the linear predictor represents a spectral envelope of the speech signal. In yet another aspect, for example, the linear prediction coefficients are generated by a speech coder.

In another exemplary aspect, the plurality of linear prediction coefficients are associated with a short-term linear predictor and a long-term linear predictor. Further, the short-term linear predictor is indicative of a spectral envelope of the speech signal and the long-term linear predictor is indicative of a pitch periodicity of the speech signal.

In one aspect, the filter is represented by:

$$\frac{[A_{noise}(z) - G_{noise}A_{LP}(z)]}{A_{noise}(z)},$$

which is used to obtain the clean speech signal estimate. Yet, in another aspect, the filter may be represented by:

$$\left[\frac{A_{ST}^{N}(z)A_{LT}^{N}(z) - G_{noise}A_{ST}^{N}(z)A_{LT}^{N}(z)}{A_{ST}^{N}(z)A_{LT}^{N}(z)}\right].$$

These and other aspects of the present invention will become apparent with further reference to the drawings and specification, which follow. It is intended that all such additional systems, methods, features and advantages be included within this description, be within the scope of the present invention, and be protected by the accompanying claims.

BRIEF DESCRIPTION OF THE DRAWINGS

The features and advantages of the present invention will become more readily apparent to those ordinarily skilled in the art after reviewing the following detailed description and accompanying drawings, wherein.

DETAILED DESCRIPTION OF THE INVENTION

The present invention discloses various methods and systems of noise suppression. The following description contains specific information pertaining to Linear Predictive Coding (LPC) techniques. However, one skilled in the art will recognize that the present invention may be practiced in conjunction with various speech coding algorithms different from those specifically discussed in the present application as well as independent of any speech coding algorithm. Moreover, some of the specific details, which are within the knowledge of a person of ordinary skill in the art, are not discussed to avoid obscuring the present invention.

The drawings in the present application and their accompanying detailed description are directed to merely example embodiments of the present invention. To maintain brevity, other embodiments of the invention which use the principles of the present invention are not specifically described in the present application and are not specifically illustrated by the present drawings.

According to an embodiment of the present invention, noise suppression is performed in the time domain by linear predictive filtering techniques, without the need for transformations to and from the frequency domain. As discussed above, an observed speech signal comprises a clean speech signal and a noise signal, where the clean speech signal may also be referred to as the signal of interest. As explained above, the general objective of a noise suppression method or system is to receive a given observed signal and eliminate the noise signal to yield the signal of interest.

Figure 1:
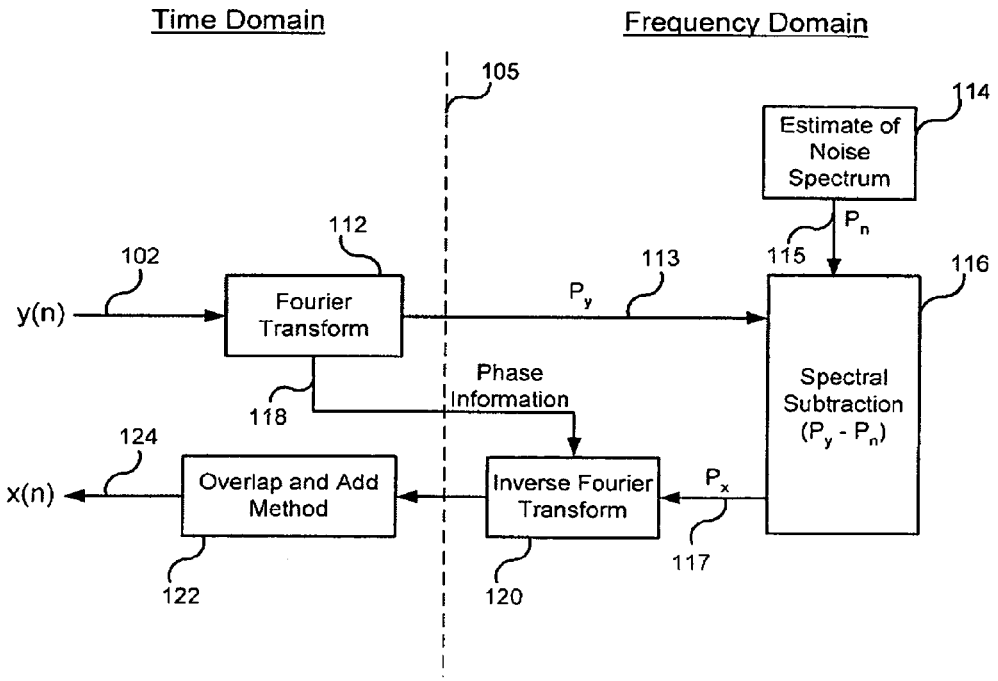
Figure 1 (Prior Art)
FIG. 1 illustrates a prior art spectral subtraction process.
Figure 2:
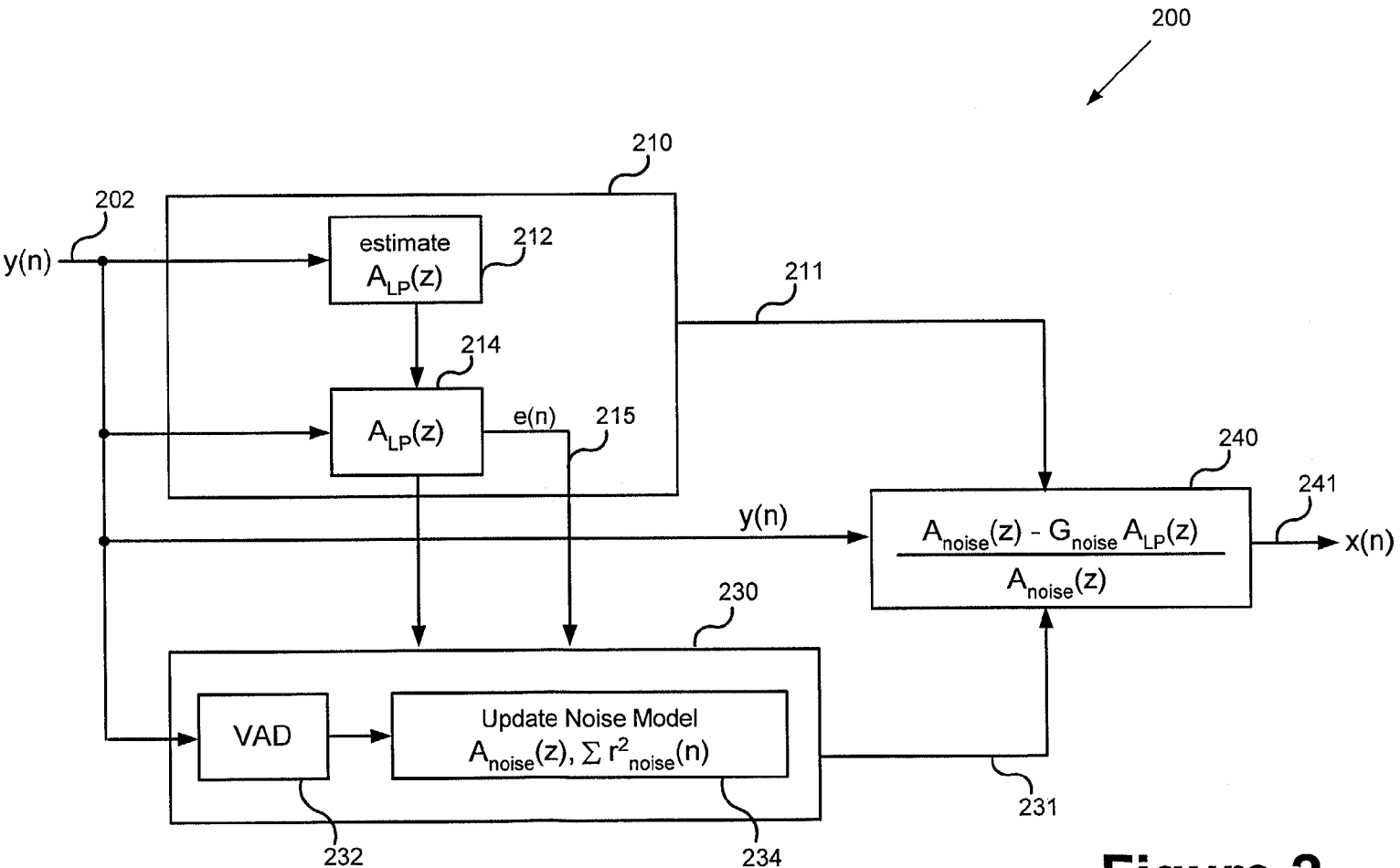
FIG. 2 illustrates an exemplary noise suppression system according to one embodiment of the present invention.

FIG. 2 illustrates noise suppression system 200, according to one embodiment of the present invention. An exemplary noise suppression process may begin with estimating linear predictive model parameters from observed speech signal y(n) 202. As used herein, a linear predictor expresses each sample of the signal as a linear combination of previous samples. More specifically, each linear predictor includes a set of prediction coefficients (or filter coefficients), which are estimated in order to represent the signal. In one embodiment, a linear predictor is used in a signal model and a noise model. In another embodiment, these models can be expanded to include a short-term linear predictor and a long-term linear predictor. As used herein, the short-term linear predictor represents the spectral envelope and the long-term linear predictor represents the pitch periodicity in the signal and noise models. In either case, the models are linear filters and the model parameters are estimated directly from the observed signal. As used herein, the index "z" is a z-domain index of the linear filter, and the index "n" is a time domain index.

According to one embodiment of the present invention, noise suppression system 200 includes three primary modules, namely, signal module 210, noise module 230, and noise suppression filter 240. Signal module 210 is configured to produce observed speech signal estimate 211, noise module 230 is configured to produce noise signal estimate 231, and noise suppression filter 240 is configured to produce clean speech signal estimate x(n) 241, which is the signal of interest. Noise suppression system 200 is capable of obtaining clean speech signal estimate x(n) 241 by utilizing a filter that is derived from noise signal estimate 231 and observed speech signal estimate 211, where the parameters of signal module 210 and noise module 230 are estimated from observed signal y(n) 202. It should be noted that noise suppression system 200 may be block-based, wherein a block of samples is processed at a time, i.e. y(n) . . . y(n+N−1), where N is the block size. During each block, the signal is analyzed and filter parameters are derived for that block of samples, such that the filter parameters within a block are kept constant. Accordingly, typically, the coefficients of the filter(s) would remain constant block by block.

Referring to signal module 210, a single linear predictor $A_{LP}(z)$, for example, may be used to model observed speech signal y(n) 202. In first predictor element 212, linear predictor $A_{LP}(z)$ is estimated based on observed speech signal y(n) 202, where linear predictor $A_{LP}(z)$ represents the spectral envelope of observed speech signal y(n) 202, and is given by:

$$A_{LP}(z) = 1 - \sum_{i=1}^{Np} a_i z^{-i}$$

where $1/A_{LP}(z)$ represents the filter response (or synthesis filter) represented by the z-domain transfer function, "$a_i$", $i=1 \ldots N_p$ are the linear predictive coefficients, and $N_p$ is the prediction order or filter order of the synthesis filter. The variable "z" is a delay operator and the prediction coefficients "$a_i$", characterize the resonances (or formants) of the observed speech signal y(n) 202. The values for "$a_i$" are estimated by minimizing the mean-square error between the estimated signal and the observed signal. The coefficients of $A_{LP}(z)$ can be estimated by taking a window of the observed signal y(n) 202, calculating the correlation coefficients, and then applying the Levinson-Durbin algorithm to solve the $N_{pth}$-order system of linear equations and yield estimates of the $N_p$ prediction coefficients: $a_i=a_1, a_2, \ldots a_{Np}$. As known in the art, the Levinson-Durbin recursion is a linear minimum-mean-squared-error estimator, which has applications in filter design, coding, and spectral estimation. The z-transform of observed speech signal estimate 211 can be expressed as:

$$Y(z) = \frac{1}{A_{LP}(z)} R(z)$$

where linear predictor $A_{LP}(z)$ represents the spectral envelope of observed speech signal y(n) 202, as described above, and R(z) is the z-transform representation of the residual signal, r(n).

Next, in second predictor element 214, the prediction coefficients "$a_i$", found in first predictor element 212, are used to generate the prediction error signal e(n) 215. The prediction error signal e(n) 215 is also referred to as the residual signal. As used herein, prediction error signal e(n) 215 may also be represented by "r(n)". Mathematically, the prediction error signal e(n) 215 represents the error at a given time "n" between observed speech signal y(n) 202 and a predicted speech signal $y_p(n)$ that is based on the weighted sum of its previous values:

$$e(n) = r(n) = y(n) - y_p(n) = y(n) - \sum_{i=1}^{Np} a_i y(n-i).$$

The linear prediction coefficients "$a_i$" are the coefficients that yield the best approximation of $y_p(n)$ to y(n) 202. Next, the values of the prediction error signal e(n) 215 and the prediction coefficients "$a_i$" are forwarded to noise module 230. At this point, voice activity detector (VAD) 232 determines the presence or absence of speech in observed speech signal y(n) 202.

Figure 4:
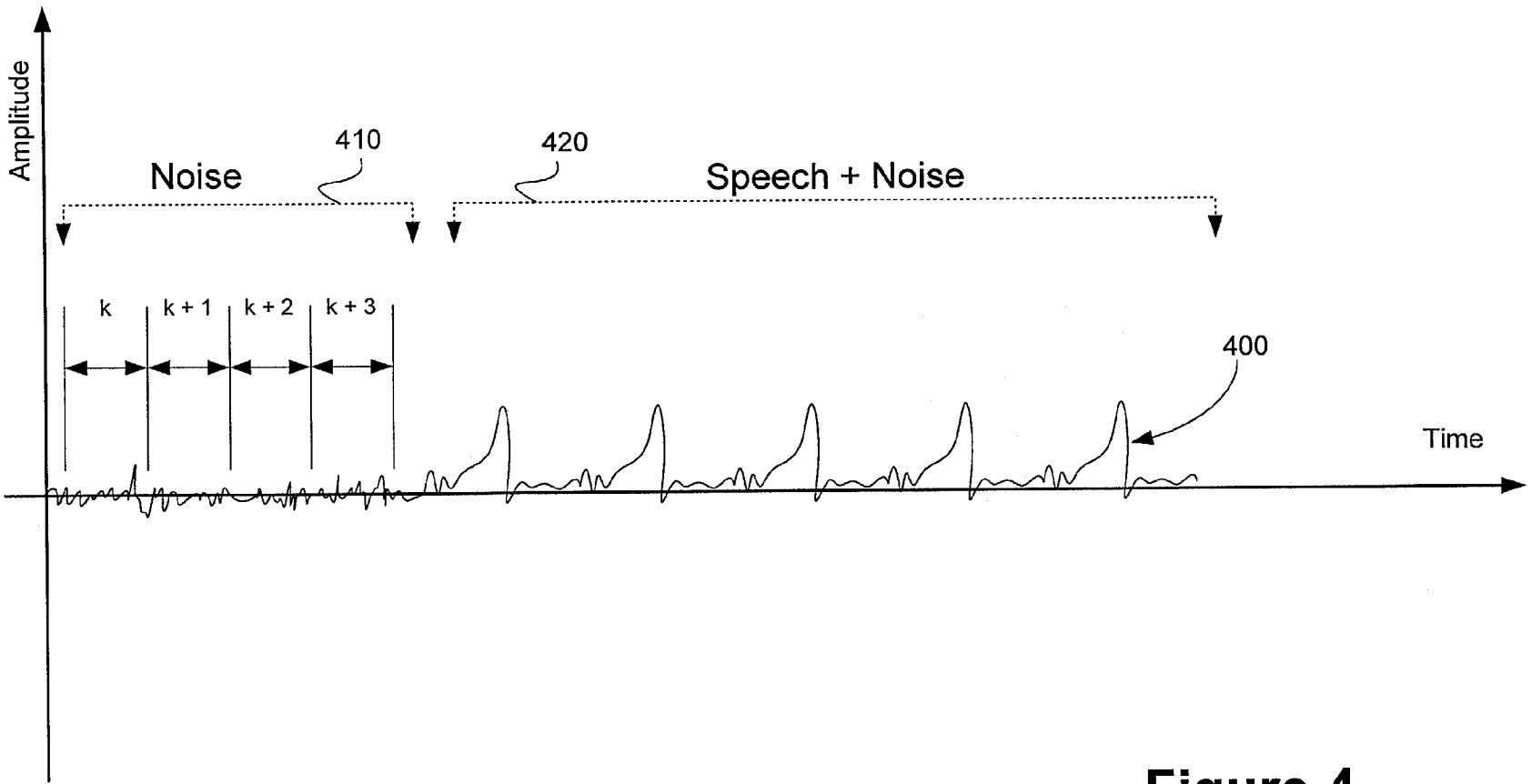
FIG. 4 illustrates an exemplary speech signal.

Turning to FIG. 4, observed speech signal y(n) 202 may be represented by speech signal 400, which includes speech and non-speech segments. Segment 410 represents the background noise (or additive noise signal), which is assumed to be independent of the clean speech signal. On the other hand, segment 420 includes the clean speech signal in addition to the underlying additive noise signal.

Now, in updating noise model 234, the $N_p$ predictions coefficients "$a_i$" are transformed into the line spectral frequency (LSF) domain in a one-to-one transformation to yield $N_p$ LSF coefficients. In other words, the LSF parameters are derived from the polynomial $A_{LP}(z)$. The noise estimate is obtained by smoothing the LSF parameters during non-speech segments, i.e. segments 410 of FIG. 4, such that unwanted fluctuations in the spectral envelope are reduced. The smoothing process is controlled by the information from VAD 232 and possibly the evolution of the spectral envelope.

It is noted that because the noise parameters are slowly evolving, they are relatively constant over any time period "k", "k+1", "k+2", and so forth, as shown in FIG. 4, where k is a time-block index, e.g. a block typically of a duration of 10 to 20 ms. A running mean of the LSF of noise is created and updated during non-speech segments of the observed signal y(n) 202:

$$LSF^{N}_{k+1}(i)=\alpha * LSF^{N}_{k}(i)+(1-\alpha)LSF(i),\ i=1, 2 \ldots, N_p$$

The weighing factor, "α", may be equal to 0.9, for example. The LSF of noise is then transformed back to prediction coefficients, which provides the spectral estimate of the noise signal, $A_{noise}(z)$. When no speech is detected by VAD 232, e.g. during segment 410 of FIG. 4, the noise parameters in update noise model 234 are updated, i.e. the linear predictor of noise $A_{noise}(z)$, and the residual energy of the noise signal $\Sigma\, r^2_{noise}(n)$ are updated. The energy of the noise signal, $\sqrt{\Sigma r^2_{noise}(n)}$, for example, may be obtained by performing a moving average smoothing technique of $\sqrt{\Sigma r^2(n)}$ over non-speech segments, as known in the art. Additionally, an estimate of a noise gain may be calculated as:

$$G_{noise}=[\sqrt{\Sigma r^2_{noise}(n)}]/[\sqrt{\Sigma r^2(n)}]$$

and the z-transform of signal noise estimate 231 is expressed as:

$$E(z) = \frac{G_{noise}N(z)}{A_{noise}(z)}$$

where N(z) is the z-transform of the residual of the noise signal, n(n). By making an assumption (which is equivalent to the phase assumption in spectral subtraction methods) that the phase of the signal is approximated by the phase of the noisy signal and N(z)≈R(z), the z-transform of signal noise estimate 231 can be written as:

$$E(z) = \frac{G_{noise}R(z)}{A_{noise}(z)} = \frac{G_{noise}[Y(z)A_{LP}(z)]}{A_{noise}(z)}$$

Thus, at update noise model 234, the spectral estimate of noise signal estimate 231 may be calculated and updated based on the information from VAD 232. Next, observed speech signal estimate 211 and noise signal estimate 231 are received by noise suppression filter 240. An estimate of clean speech signal x(n) 241 is calculated by subtracting noise signal estimate 231 from observed speech signal estimate 211, as expressed below in the z-domain:

$$X(z) = Y(z) - E(z) = Y(z)\left[1 - \frac{G_{noise}A_{LP}(z)}{A_{noise}}\right] = Y(z)\frac{[A_{noise}(z) - G_{noise}A_{LP}(z)]}{A_{noise}(z)}$$

where $$\frac{[A_{noise}(z) - G_{noise}A_{LP}(z)]}{A_{noise}(z)}$$

is the noise suppression filter 240 derived from the linear prediction based spectral representations of the noise signal 231 and observed speech signal 211, respectively. In practice, observed speech signal y(n) 202 is passed through noise suppression filter 240 to generate clean speech signal estimate x(n) 241, and noise suppression process is complete.

Figure 3:
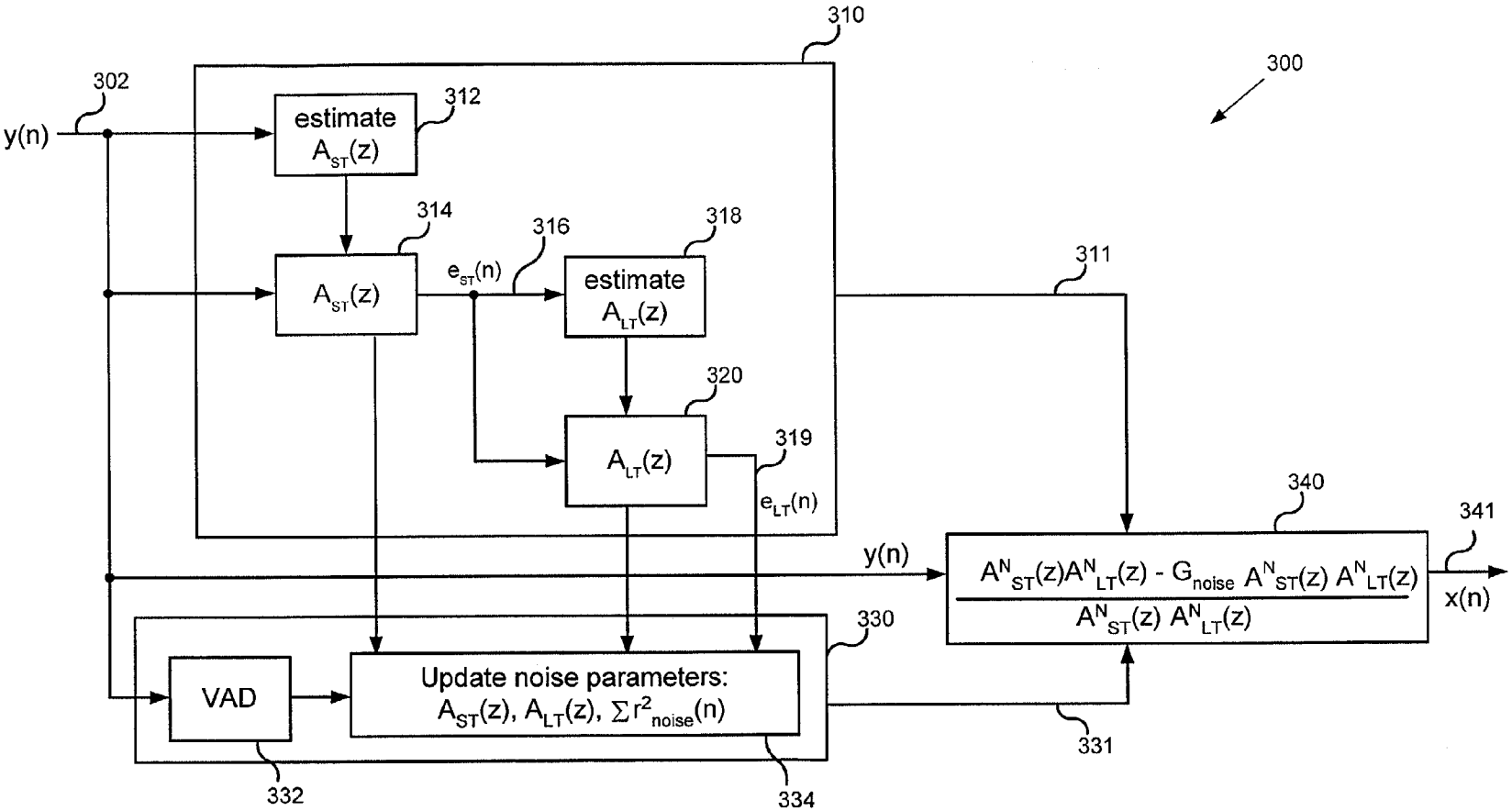
FIG. 3 illustrates an exemplary noise suppression system according to another embodiment of the present invention.

FIG. 3 illustrates noise suppression system 300, according to another embodiment of the present invention. Noise suppression system 300 is an improved version of noise suppression system 200 of FIG. 2, which further accounts for the representation of the pitch periodicity of the observed speech signal. For example, in noise suppression system 200 of FIG. 2, a general linear predictor $A_{LP}(z)$, is used to represent the spectral envelope of observed speech signal y(n) 202, whereas in noise suppression system 300 of FIG. 3, two linear predictors are used to represent observed speech signal y(n) 302. In other words, a short-term linear predictor $A_{ST}(z)$ is used to represent the spectral envelope and a long-term linear predictor $A_{LT}(z)$ is used to represent the pitch periodicity. As stated above, noise suppression system 200 may be block-based, wherein a block of samples is processed at a time, i.e. y(n) . . . y(n+N−1), where N is the block size. During each block, the signal is analyzed and filter parameters are derived for that block of samples, such that the filter parameters within a block are kept constant. Accordingly, typically, the coefficients of the filter(s) would remain constant block by block.

Noise suppression system 300 includes three primary modules, namely, signal module 310, noise module 330, and noise suppression filter 340. As discussed above, the main object of noise suppression system 300 is to obtain an estimate of clean speech signal x(n) by passing observed speech signal y(n) 302 through a noise suppression filter 340 that is derived from the linear prediction based spectral representations of the noise signal 331 and observed speech signal 311, respectively. Furthermore, the parameters of signal module 310 and noise module 330 are estimated directly from observed speech signal y(n) 302. Referring to signal module 310, short-term linear predictor $A_{ST}(z)$ and long-term linear predictor $A_{LT}(z)$ are used to model observed speech signal y(n) 302.

At first short-term predictor element 312, the short-term linear predictor $A_{ST}(z)$ is estimated based on observed speech signal y(n) 302. The short-term linear predictor $A_{ST}(z)$ represents the spectral envelope of observed speech signal y(n) 302, and is given by:

$$A_{ST}(z) = 1 - \sum_{i=1}^{N_p} a_i z^{-i}.$$

The values for "$a_i$" and $A_{ST}(z)$ are determined as described in conjunction with $A_{LP}(z)$ in noise suppression algorithm 200. The value of $A_{ST}(z)$ can be estimated by taking a window of observed signal y(n) 302, calculating the correlation coefficients, and then applying the Levinson-Durbin algorithm to solve the $N_{pth}$-order system of linear equations to yield estimates of the $N_p$ prediction coefficients: $a_1, a_2, \ldots a_{Np}$.

At second short-term predictor element 314, the prediction coefficients "$a_i$" found in the estimate of $A_{ST}(z)$ are used to generate the short-term prediction error signal $e_{ST}(n)$ 316, which is also referred to as the short-term residual signal:

$$e_{ST}(n) = y(n) - y_p(n) = y(n) - \sum_{i=1}^{N_p} a_i y(n-i).$$

Short-term prediction error signal $e_{ST}(n)$ 316 represents the error at a given time "n" between observed speech signal y(n) 302 and a predicted speech signal $y_p(n)$ that is based on the weighted sum of its previous values. Short-term prediction error signal $e_{ST}(n)$ 316 is then used in first long-term predictor element 318 to determine an estimate for the long-term predictor $A_{LT}(z)$:

$$A_{LT}(z)=1-\beta z^{-L}$$

where L represents the pitch lag. The long-term predictor $A_{LT}(z)$ is a first order pitch predictor that represents the pitch periodicity of observed speech signal y(n) 302. The z-transform of observed speech signal 311 can thus be expressed as:

$$Y(z) = \frac{1}{A_{ST}(z)A_{LT}(z)} R(z)$$

Next, at second long-term predictor element 320, short-term prediction error signal $e_{ST}(n)$ 316 and an estimate of the long-term predictor $A_{LT}(z)$ are used to generate long-term prediction error signal $e_{LT}(n)$ 319, which is also referred to as the long-term residual signal or r(n):

$$e_{LT}(n)=r(n)=e_{ST}(n)-\beta e_{ST}(n-L)$$

At this point, voice activity detector (VAD) 332 determines the speech and non-speech segments of observed speech signal y(n) 302. As discussed above, observed speech signal y(n) 302 may be represented by speech signal 400 of FIG. 4, which consists of non-speech and speech segments, i.e. segments 410 and 420, respectively. A segment of observed signal y(n) 302 in which no speech is detected, i.e. the background noise (or additive noise signal) may be represented by segment 410 of speech signal 400, which is assumed to be independent of the clean speech signal. Additionally, a segment of observed speech signal y(n) 302 in which speech is detected may be represented by segment 420 of speech signal 400. The $N_p$ predictions coefficients "$a_i$" are then transformed into the line spectral frequency (LSF) domain in a one-to-one transformation to yield $N_p$ LSF coefficients. In other words, the LSF parameters are derived from the polynomial $A_{ST}(z)$. The linear prediction based spectral envelope representation of the noise is obtained by smoothing the LSF parameters during non-speech segments, e.g. segment 410 of FIG. 4, such that unwanted fluctuations in the spectral envelope are reduced. The smoothing process is controlled by the information obtained from VAD 332 and possibly the evolution of the spectral envelope. A running mean of the LSF of noise is created and updated during non-speech segments of the observed signal y(n) 302 as follows:

$$LSF^N_{k+1}(i)=\alpha^* LSF^N_k(i)+(1-\alpha)LSF(i), i=1,2 \ldots, N_p$$

The weighing factor, "α", may be equal to 0.9, for example. The LSF of noise is then transformed back to prediction coefficients, which provides the spectral envelope estimate of the noise signal, $A^N_{ST}(z)$. When no speech is detected by VAD 332, the noise parameters in update noise parameter 334 are updated. In other words, the linear predictors of noise $A^N_{ST}(z)$ and $A^N_{LT}(z)$, and the pitch prediction residual energy of the noise signal $\Sigma r^2_{noise}(n)$, are all updated. The long-term linear predictor of noise, $A^N_{LT}(z)$, may, for example, be obtained by using a smoothing technique on the coefficients β and utilizing the pitch lag L of the current frame. Further, an estimate of the noise gain is calculated as:

$$G_{noise}=[\sqrt{\Sigma r^2_{noise}(n)}]/[\sqrt{\Sigma r^2(n)}]$$

and the z-transform of signal noise estimate 331 is expressed as:

$$E(z) = \frac{1}{A^N_{ST}(z)A^N_{LT}(z)} N(z)$$

where N(z) is the z-transform of the residual noise signal, n(n). By making an assumption, which is equivalent to the phase assumption in spectral subtraction methods, the z-transform of signal noise estimate 331 can be written as:

$$E(z) = \frac{G_{noise}R(z)}{A_{ST}^{N}(z)A_{LT}^{N}(z)} = \frac{G_{noise}[Y(z)A_{ST}^{N}(z)A_{LT}^{N}(z)]}{A_{ST}^{N}(z)A_{LT}^{N}(z)}$$

Thus, at update noise parameters 334, the spectral estimate of noise signal, i.e. noise signal estimate 331, is calculated, and updated based on the information obtained from VAD 332. If the noise signal does not exhibit any periodicity, for example, then noise signal estimate 331 may not require the linear predictor for periodicity. As a result, long-term predictor $A_{LT}(z)$ and the spectral envelope can be estimated by short-term predictor $A_{ST}(z)$:

$$E(z) = \frac{G_{noise}[Y(z)A_{ST}^{N}(z)A_{LT}^{N}(z)]}{A_{ST}^{N}(z)}$$

(simplified noise model—no periodicity)

Next, the linear prediction based spectral representations of observed speech signal 311 and noise signal estimate 331 are received by noise suppression filter 340. An estimate of the clean speech signal x(n) 341, is calculated by subtracting noise signal estimate 331 from observed speech signal estimate 311, as expressed below in the z-domain:

$$\begin{aligned} X(z) = Y(z) - E(z) &= Y(z)\left[1 - G_{noise}\frac{A_{ST}^{N}(z)A_{LT}^{N}(z)}{A_{ST}^{N}(z)A_{LT}^{N}(z)}\right] \\ &= Y(z)\left[\frac{A_{ST}^{N}(z)A_{LT}^{N}(z) - G_{noise}A_{ST}(z)A_{LT}(z)}{A_{ST}^{N}(z)A_{LT}^{N}(z)}\right] \end{aligned}$$

where $$\left[\frac{A_{ST}^{N}(z)A_{LT}^{N}(z) - G_{noise}A_{ST}^{N}(z)A_{LT}^{N}(z)}{A_{ST}^{N}(z)A_{LT}^{N}(z)}\right]$$

is noise suppression filter 340 derived from The linear prediction based spectral representations of the noise 331 and observed speech signal 311. In practice, observed speech signal y(n) 302 is passed through noise suppression filter 340 to generate clean speech signal estimate x(n) 341, and noise suppression process is complete.

In the manner described above, noise suppression system 200 and noise suppression system 300 use time domain filtering to suppress additive noise in an observed speech signal, thereby avoiding the more complex operations and possible delays found in many existing frequency domain noise suppression techniques. More specifically, the present invention does not require Fourier transformations between the time and frequency domain and subsequent overlap and adding procedures, as is the case with the traditional spectral subtraction methods. Auto-regressive linear predictive models may be used in the present invention to provide an all-pole model of the spectrum of an observed speech signal, and noise suppression is performed with time-domain filtering.

Accordingly, in some applications, the present invention can provide significantly less complex means of noise suppression while maintaining adequate effectiveness. As an example, in an embodiment of the present invention, a linear prediction based speech coder may provide the linear predictor coefficients as parameters of its decoder. In such embodiment, for example, the linear predictors, i.e. $A_{ST}(z)$ and $A_{LT}(z)$, do not need to be estimated by noise suppression systems 200 or 300, which further simplifies the present invention relative to conventional solutions.

From the above description of the invention it is manifest that various techniques can be used for implementing the concepts of the present invention without departing from its scope. Moreover, while the invention has been described with specific reference to certain embodiments, a person of ordinary skill in the art would recognize that changes can be made in form and detail without departing from the spirit and the scope of the invention. The described embodiments are to be considered in all respects as illustrative and not restrictive. It should also be understood that the invention is not limited to the particular embodiments described herein, but is capable of many rearrangements, modifications, and substitutions without departing from the scope of the invention.

What is claimed is:

1. A time-domain noise suppression method for suppressing a noise signal in a speech signal, said time-domain noise suppression method comprising:

estimating a plurality of linear prediction coefficients for said speech signal;

generating a prediction error estimate based on said plurality of prediction coefficients;

generating an estimate of said speech signal based on said plurality of linear prediction coefficients;

using a voice activity detector to determine a voice activity in said speech signal;

updating a plurality of noise parameters based on said prediction error estimate if said voice activity detector determines no voice activity in said speech signal;

generating an estimate of said noise signal based on said plurality of noise parameters; and passing said speech signal through a filter derived from said estimate of said noise signal and said estimate of said speech signal to generate a clean speech signal estimate;

wherein said plurality of linear prediction coefficients are associated with a short-term linear predictor indicative of a spectral envelope of said speech signal and a long-term linear predictor indicative of a pitch periodicity of said speech signal, and wherein said plurality of noise parameters include a spectral estimate of said noise signal and a residual energy of said noise signal.

2. The time-domain noise suppression method of claim 1, wherein $A_{noise}(z)$ is said spectral estimate of said noise signal and $\Sigma\, r^2_{noise}(n)$ is said residual energy of said noise signal.

3. The time-domain noise suppression method of claim 1, wherein said linear prediction coefficients are generated by a speech coder.

4. The time-domain noise suppression method of claim 1, wherein said filter is represented by:

$$\frac{[A_{noise}(z) - G_{noise}A_{LP}(z)]}{A_{noise}(z)},$$

wherein $A_{noise}(z)$ is said spectral estimate of said noise signal, and $G_{noise}A_{LP}(z)$ is an estimate of a noise gain.

5. The time-domain noise suppression method of claim 1, wherein said filter is represented by:

$$\left[\frac{A_{ST}^{N}(z)A_{LT}^{N}(z) - G_{noise}A_{ST}^{N}(z)A_{LT}^{N}(z)}{A_{ST}^{N}(z)A_{LT}^{N}(z)}\right],$$

wherein $A^{N}_{ST}(z)$ is a short-term linear predictor of said noise signal, $A^{N}_{LT}(z)$ is a long-term linear predictor of said noise signal, and $G_{noise}A_{LP}(z)$ is an estimate of a noise gain.

6. A device capable of time-domain noise suppression for suppressing a noise signal in a speech signal, said device comprising:

a signal module including a linear predictor capable of generating an estimate of said speech signal based on a plurality of linear prediction coefficients estimated for said speech signal, wherein said signal module is capable of generating a prediction error estimate based on said plurality of prediction coefficients;

a noise module including a voice activity detector capable of determining a voice activity in said speech signal and an update noise model element capable of updating a plurality of noise parameters based on said prediction error estimate if said voice activity detector determines no voice activity in said speech signal, and generating an estimate of said noise signal based on said plurality of noise parameters; and a noise suppression filter derived from said estimate of said noise signal and said estimate of said speech signal, said noise suppression filter capable of receiving said speech signal and generating a clean speech signal estimate;

wherein said plurality of linear prediction coefficients are associated with a short-term linear predictor indicative of a spectral envelope of said speech signal and a long-term linear predictor indicative of a pitch periodicity of said speech signal, wherein said plurality of noise parameters include a spectral estimate of said noise signal and a residual energy of said noise signal.

7. The device of claim 6, wherein $A_{noise}(z)$ is said spectral estimate of said noise signal and $\Sigma\, r^{2}_{noise}(n)$ is said residual energy of said noise signal.

8. The device of claim 6, wherein said linear prediction coefficients are generated by a speech coder.

9. The device of claim 6, wherein said filter is represented by:

$$\frac{[A_{noise}(z) - G_{noise}A_{LP}(z)]}{A_{noise}(z)},$$

wherein $A_{noise}(z)$ is said spectral estimate of said noise signal, and $G_{noise}A_{LP}(z)$ is an estimate of a noise gain.

10. The device of claim 6, wherein said filter is represented by:

$$\left[\frac{A_{ST}^{N}(z)A_{LT}^{N}(z) - G_{noise}A_{ST}^{N}(z)A_{LT}^{N}(z)}{A_{ST}^{N}(z)A_{LT}^{N}(z)}\right],$$

wherein $A^{N}_{ST}(z)$ is a short-term linear predictor of said noise signal, $A^{N}_{LT}(z)$ is a long-term linear predictor of said noise signal, and $G_{noise}A_{LP}(z)$ is an estimate of a noise gain.

11. A time-domain noise suppression method for suppressing a noise signal in a speech signal, said time-domain noise suppression method comprising:

estimating a plurality of linear prediction coefficients for said speech signal;

generating a prediction error estimate based on said plurality of prediction coefficients;

generating an estimate of said speech signal based on said plurality of linear prediction coefficients;

using a voice activity detector to determine a voice activity in said speech signal;

updating a plurality of noise parameters based on said prediction error estimate if said voice activity detector determines no voice activity in said speech signal;

generating an estimate of said noise signal based on said plurality of noise parameters; and passing said speech signal through a filter derived from said estimate of said noise signal and said estimate of said speech signal to generate a clean speech signal estimate;

wherein said plurality of linear prediction coefficients are associated with a short-term linear predictor indicative of a spectral envelope of said speech signal and a long-term linear predictor indicative of a pitch periodicity of said speech signal, wherein said filter is represented by:

$$\frac{[A_{noise}(z) - G_{noise}A_{LP}(z)]}{A_{noise}(z)},$$

wherein $A_{noise}(z)$ is a spectral estimate of said noise signal, and $G_{noise}A_{LP}(z)$ is an estimate of a noise gain.

12. The time-domain noise suppression method of claim 11, wherein said plurality of noise parameters include said spectral estimate of said noise signal and a residual energy of said noise signal.

13. The time-domain noise suppression method of claim 12, wherein $\Sigma\, r^{2}_{noise}(n)$ is said residual energy of said noise signal.

* * * * *